US005116359A

United States Patent [19]

Moore

[11] Patent Number: 5,116,359

[45] Date of Patent: May 26, 1992

[54] HEAD, NECK AND SHOULDER THERAPEUTIC EXERCISE DEVICE

[76] Inventor: Joseph L. Moore, 918 Green Valley Dr., Abilene, Tex. 79601

[21] Appl. No.: 622,636

[22] Filed: Dec. 5, 1990

[51] Int. Cl.[5] ..... A61H 1/02

[52] U.S. Cl. ..... 606/241; 482/10; 128/25 R

[58] Field of Search ..... 128/75, 68, 69, 71, 128/76 R, 84 R, 25 R; 272/94

[56] References Cited

U.S. PATENT DOCUMENTS

| | | | |
|---|---|---|---|
| 3,596,655 | 8/1971 | Corcoran | 128/75 |
| 3,621,839 | 11/1971 | Barthe | 128/75 |
| 3,643,996 | 2/1972 | Carnahan | 128/75 X |
| 3,710,787 | 1/1973 | Rabjohn | 128/75 |
| 3,847,146 | 11/1974 | Cushman | 128/75 |
| 3,878,840 | 4/1975 | Esbelin | 128/68 X |
| 4,161,946 | 7/1979 | Zuesse | 128/75 |
| 4,278,249 | 7/1981 | Forrest | 272/94 |
| 4,583,532 | 4/1986 | Jones | 128/75 |
| 4,768,779 | 9/1988 | Oehman, Jr. et al. | 272/94 |
| 4,893,808 | 1/1990 | McIntyre et al. | 272/94 |
| 4,989,859 | 2/1991 | Jones | 272/94 |
| 5,010,898 | 4/1991 | Kanawati et al. | 128/75 X |

FOREIGN PATENT DOCUMENTS

| | | | |
|---|---|---|---|
| 980199 | 12/1975 | Canada | 128/75 |
| 1371332 | 7/1964 | France | 128/75 |

OTHER PUBLICATIONS

"The Super Neck Developer," *Coach & Athlete*, Jan.-/Feb. 1979, vol. XXXXI, Number 4.

*Primary Examiner*—Richard J. Apley
*Assistant Examiner*—Linda C. M. Dvorak

[57] ABSTRACT

A head, neck and shoulder therapeutic exercise device which mechanically assists the human head and neck with intermittent rearward/forward movement in order to help correct or attenuate by means of muscular conditioning the cervical misalignment associated with forward head and flexible cervical lordosis. Mounted on a chair, an adjustable frame supports above the patient's head a motor assembly in fixed position and a motion-assist assembly which is horizontally moveable. The latter comprises in part a roller block with affixed roller bearing plate extending down behind the patient's head. The motor shaft, also behind the patient's head, has a cam which rides against a roller bearing in the roller bearing plate. As the cam's high side rotates against the bearing, the bearing plate moves away from the patient, thereby transferring rearward tension to the head by means of stretchable straps attached to said bearing plate and placed around the patient's forehead and chin. Each rotation of the cam is briefly halted by a timer when the head is in retracted position. After a holding phase, the rotation resumes, returning everything to original position. The head displacement distance is controlled by variously sized interchangeable cams. During therapy, the patient tries to do chin tuck exercises to accompany the cyclic mechanical movement.

3 Claims, 1 Drawing Sheet

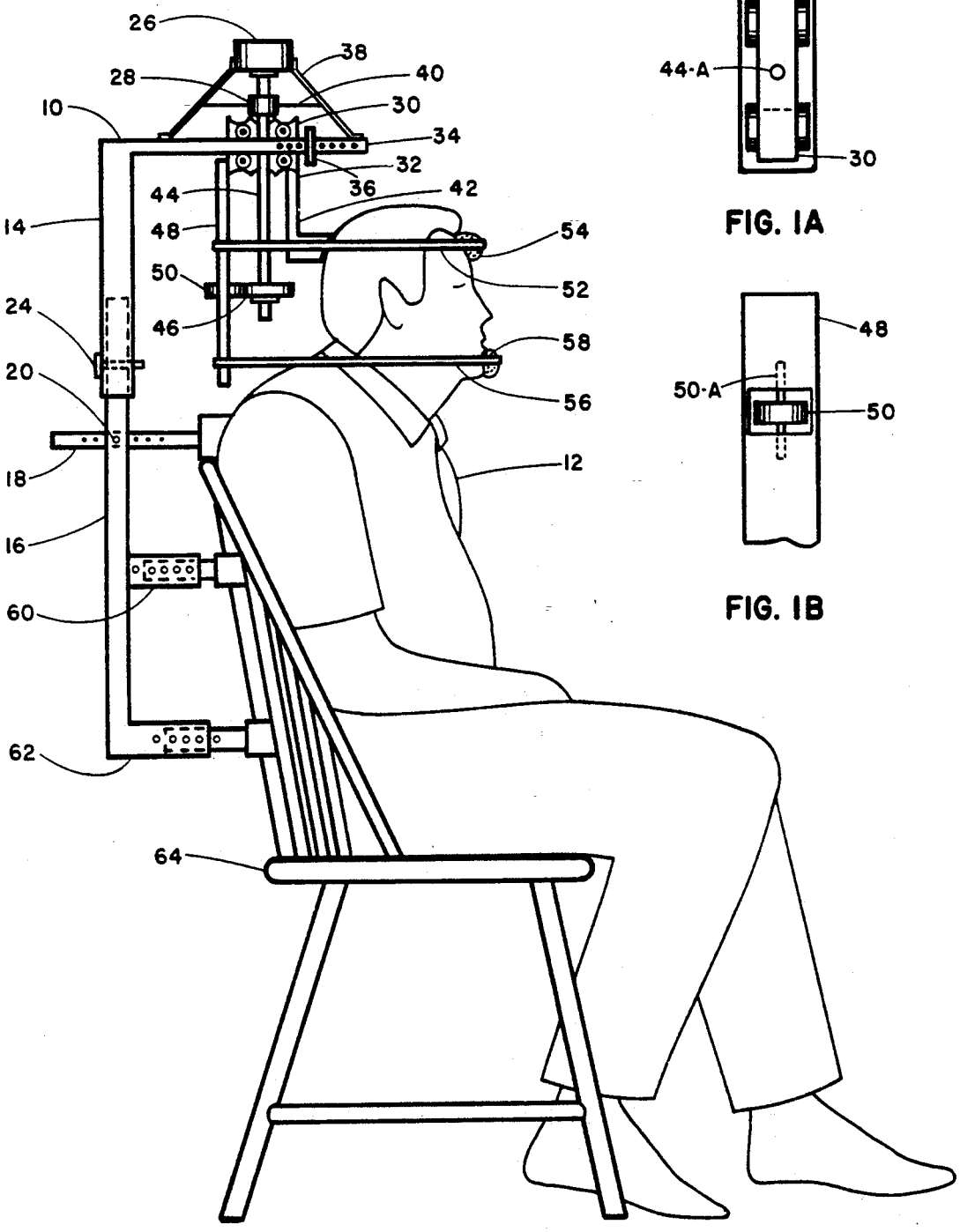
FIG. 1
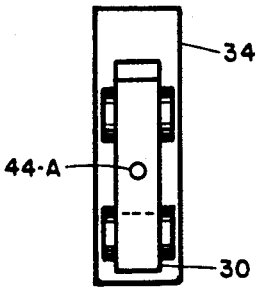
FIG. 1A
FIG. 1B

HEAD, NECK AND SHOULDER THERAPEUTIC EXERCISE DEVICE

BACKGROUND OF THE INVENTION and PRIOR ART

The cervical spine misalignment associated with forward head and cervical lordosis, which frequently is accompanied by round shoulders and round upper back, can result over time from one or a combination of factors such as 1) a subconscious slumping in an effort to alleviate the pain of neck injury or similar trauma, 2) a general weakening of the muscles of the neck, shoulders and/or upper back and 3) habitual inattention to proper posture. Persons with the condition of forward head or cervical lordosis commonly lack the strength, motivation and/or perseverance necessary to endure the rigors of unassisted therapeutic neck exercises designed to overcome the problem. In their attempt to re-educate the pertinent muscles (along with the subconscious mind) for the purpose of achieving and maintaining proper alignment of the cervical spine, they often are confronted with more impediments than they can overcome alone, including muscle atrophy, low energy level, pain, reduced neck mobility and the subconsciously ingrained habit of slumping. For this reason, the self-administered chin tucks and other exercises that are often prescribed by physical therapists to help correct the stooping carriage of the head and neck do not enjoy a particularly high success rate. Such incorrect head and neck posture and its frequently concomitant pain and muscle dysfunction, however, can be remedied or at least improved in many cases with proper help. What is needed and what has heretofore been unavailable is a means of providing safe, effective assistance with the initial phases of neck exercise therapy, so that the affected individual eventually will be able to engage in unassisted exercise in order to develop the muscle strength and tone necessary for healthy, proper head and neck position.

The various apparatus which to date have been devised to improve or offset the physical condition(s) of the human neck can be grouped into three principal categories:

1. traction therapy devices which apply tension to the head as means of stretching muscles and/or the spinal column, e.g., the U.S. patents of Cushman (U.S. Pat. No. 3,847,146), Rabjohn (U.S. Pat. No. 3,710,787), Jones (U.S. Pat. No. 4,583,532), Corcoran (U.S. Pat. No. 3,596,655) and Barthe (U.S. Pat. No. 3,621,839), the Canadian patent of Corcoran (980,199) and the French patent of Laur (1,371,332);
2. support devices which function to hold the head erect or support it in a desired position, e.g., the U.S. patents of de Kanawati, et al. (U.S. Pat. No. 5,010,898), Carnahan (U.S. Pat. No. 3,643,996), Zuesse (U.S. Pat. No. 4,161,946) and
3. strength development devices which provide predetermined resistance for the purpose of augmenting and, in some cases, evaluating neck muscle strength, e.g., the U.S. patents of McIntyre et al. (U.S. Pat. No. 4,893,808), Forrest (U.S. Pat. No. 4,278,249), Oehman, Jr. et al. (U.S. Pat. No. 4,768,779) and Jones (U.S. Pat. No. 4,989,859). See also "The Super Neck Developer" in Coach & Athlete, Vol. XXXXI, No. 4, January/February 1979.

None of the aforementioned categories of apparatus is designed appropriately for addressing the types of cervical misalignment associated with the conditions of forward head and cervical lordosis. But of the three categories, the strength development devices probably come closest to constituting prior art with respect to the present invention simply because they share with the present invention the common goal of conditioning the muscles of the neck. Such neck strength development devices of the art of record, however, are not directly applicable to nor suitable for the initial stages of remedying the condition of abnormal forward head and neck placement, because they ignore the physical limitations of many persons who have said problem. Neck strength development devices, rather than assisting neck movement, are designed to provide a predetermined resistance to said movement, which is precisely what is not initially needed by persons trying to correct the head/neck posture and cervical spine misalignment addressed by this disclosure. Said neck strength development apparatus have possible application at later stages of the therapy, if desired, to further strengthen the affected muscles, but only after the minimal strength needed to begin correcting abnormal forward head and neck placement has been achieved.

In brief, there has been no provision in known prior art for mechanically assisting persons with the condition of forward head or flexible cervical lordosis in the initial stages of a therapeutic neck exercise program. The present invention, however, offers a solution by providing an apparatus which administers precisely the type and amount of mechanical assistance needed by such persons.

SUMMARY OF THE INVENTION

In response to the problem of cervical spine misalignment associated with forward head and cervical lordosis, and in response to the inadequacies of the art of record in offering a solution for said problem, the present invention provides a safe and effective therapeutic exercise device for assisting in the initial stages of correction of abnormal forward head and neck position in cases in which the cervical spine is still flexible. This invention provides a frame attached or affixed to the chair in which the patient is seated, and a neck exercise mechanism which is supported by said frame. The mechanical part of the device can administer passive rearward movement to the head and neck or, depending on the physical condition of the patient, can administer the same rearward movement in the form of active-assisted exercise. This rearward movement of the head is for the purpose of restoring the function and strength of the neck, shoulder and/or upper back muscles necessary for achieving and maintaining unaided a correct, healthy posture of the head and neck. It should be noted that this invention only addresses and provides for head and neck movement about the cervical axis of extension (and, secondarily, flexion), but it does not address or provide for movement about the cervical axes of lateral flexion and rotation. Additionally, this device should be used only in the manner and with the frequency prescribed by a medical doctor or physical therapist. During each treatment session, the present invention mechanically assists the rearward movement of the patient's head as he/she attempts to do chin tuck exercises. Each functional cycle of the device involves 1) applying gentle rearward pressure to the patient's head to help it move back a selectively and precisely controlled minimal distance, 2) holding the head in the retracted position for a predetermined number of seconds and 3) releasing the pressure on the head. This cyclic procedure is continued over time until the patient's cervical spine is properly aligned and until the patient's neck, shoulder and/or upper back muscles have been strengthened and toned sufficiently either to maintain the head and neck unassisted in a normal, healthy position or at least to enable the person to do unassisted therapeutic neck exercise toward that end.

OBJECTS OF THE INVENTION

It is a principal object of the present invention to provide a new head, neck and shoulder therapeutic exercise device of novel construction which, in its simplest embodiment, is capable of mechanically applying safe, controlled, intermittent rearward pressure to the human head in the form of passive motion or, preferably, active-assisted motion in order to aid in the correction of certain conditions associated with forward head and flexible cervical lordosis. More specifically, the device is designed for the purposes of helping stretch atrophied neck muscles to proper functional length, helping restore extension (and, secondarily, flexion) mobility to the neck and helping a person to regain the muscle strength and tone necessary to improve and/or correct cervical spine misalignment. To accomplish these purposes, this invention in its preferred embodiment provides stretchable bands which are placed around the patient's forehead and chin. During the therapy session, these bands are mechanically pulled rearward (thus tensioning the head), held and then loosened in a continuous cycle. Over time the patient can regain neck strength and mobility by utilizing the neck muscles in chin tuck exercises to accompany the corresponding rearward movement and hold phases of each mechanized cycle of the device.

Another object of the present invention is to provide a head, neck and shoulder therapeutic exercise device having a means of easily making precise, incremental adjustments to the distance which a patient's head is intermittently assisted rearward according to his/her particular circumstances and need. In the preferred embodiment of this invention, this amount of horizontal displacement is determined and regulated by means of variously-sized interchangeable cams.

A further object of the present invention is to provide a head, neck and shoulder therapeutic exercise device which, in order to enhance the development of the patient's neck muscles, enters a static holding phase each time the patient's head is in the most retracted position of the therapeutic cycle. To accomplish this purpose, the preferred embodiment of the present invention is provided with a timer for halting the motorized motion for a predetermined number of seconds precisely when the high side of the cam, by means of its contact with a roller bearing, has pushed the movement-assist mechanism of the device to the most rearward point of its horizontal path.

Still another object of the present invention is to provide a head, neck and shoulder therapeutic exercise device which is readily adjustable to accommodate various human statures, head sizes and postures. In the preferred embodiment of this invention, there are forehead and chin bands, a support frame, chair attachment means, a back brace and a roller block, all of which are adjustable for accomplishing this purpose.

Yet another object of the present invention is to provide a head, neck and shoulder therapeutic exercise device of reasonable size, cost and ease of manufacture. In its preferred embodiment, this invention does not occupy a large amount of space, it is relatively inexpensive to manufacture and it can be mass produced readily.

These and other objects and advantages of the present invention will become more apparent to those skilled in the art by referring to the following detailed description of the construction and utilization of the apparatus when viewed in the light of the accompanying drawings.

BRIEF DESCRIPTION OF THE DRAWINGS

FIG. 1 is a side view of the head, neck and shoulder therapeutic exercise device herein disclosed.

FIG. 1-A is top view of the roller block and roller block frame plate.

FIG. 1-B is a cut-away exposed front view of the roller bearing plate which shows the roller bearing and keeper pin.

DETAILED DESCRIPTION OF THE PREFERRED EMBODIMENT and ITS USE

The following description and the appended drawings present a preferred embodiment of the invention, but it should be understood that the present disclosure is only exemplary of the principles and essence of the invention and is not intended to limit the invention to the specific embodiment herein described and illustrated. The true scope and range of the invention is detailed in the appended claims.

Referring to FIG. 1, an exemplary head, neck and shoulder therapeutic exercise device 10 is shown therein having a lower main frame 16 which telescopes up and into an upper main frame 14, said two main frame portions being adjusted with respect to one another and being secured together by means of a pin 24 which passes through the upper and lower main frames after the desired height is obtained and the pin holes are aligned. The patient 12 is shown sitting in a chair 64 which supports the head, neck and shoulder therapeutic exercise device 10. The lower main frame is secured onto the chair 64 by means such as clamps and is adjusted to the patient's size by means of the adjustable chair attachments 60 and 62. Each of said chair attachments provides an adjuster arm clamp which telescopes outward from the lower main frame and is secured in place by means of an adjuster pin which passes through both the lower main frame and the adjuster arm when the desired length is obtained and the pin holes provided are aligned, thereby securely stabilizing the device during treatments. An adjustable back brace 18 extends through the lower main frame 16 and is secured in place by pin 20 when back brace pad 22 is in the desired support position.

Still referring to FIG. 1, in order to further accommodate the patient for therapy, the roller block assembly (comprising an upper half 30 and a lower half 32) is adjusted horizontally and is secured in appropriate position by inserting the roller block pin 36 into the roller block plate 34 so that the back head brace 42 affixed to said roller block assembly and extending downward is positioned to be in contact with the back of the patient's head. A stretchable band 52 with forehead pad 54 is placed around the patient's forehead and around a roller bearing plate 48 which is affixed to the back of the lower roller block 32 and extends downward behind the patient's head. A stretchable chin band 56 with chin pad 58 is placed around the patient's chin and around said roller bearing plate 48.

The mechanical motion of the present invention is provided in the following way. Still referring to FIG. 1, there is mounted in a fixed position onto the upper main frame 14 an electric motor 26 secured by means of metal brace straps 38 which extend out and down, and which are secured permanently to the roller block plate 34. The motor shaft 44 extends down from the electric motor 26 through the rotational speed reduction gear box 28 (which is secured and stabilized by metal brace straps 40), through the upper half of the roller block assembly 30, through the roller block plate 34 (by means of motor shaft passageway 44-A, shown in FIG. 1A), and through the lower half of the roller block assembly 32. Said roller block assembly is constructed having elongated openings top and bottom so that it can move horizontally without encumbrance from the motor shaft 44 which passes perpendicularly through it, because said motor shaft itself does not move horizontally. A treatment cam 46 is mounted onto the lower portion of the motor shaft 44 and rides against a roller bearing 50 which is securely housed in an opening in a roller bearing plate 48. Said roller bearing plate is affixed to the back of the lower half of the roller block assembly 32, so that when said roller block assembly moves, the roller bearing plate 48 moves also. The roller bearing 50 extends out beyond the surface of the roller bearing plate 48, thus allowing the cam 46 to ride against said roller bearing. The activation of motor 26 causes motor shaft 44 and cam 46 to rotate. As the high side of said cam comes into contact with the roller bearing 50, said bearing and the roller bearing plate 48 which houses it are moved a slight distance farther away from the back of the patient's head, thereby causing the forehead band 52 and the chin band 56 to exert an increased rearward tension on the patient's head. This tension alerts the patient capable of active-assisted motion to begin doing a chin tuck exercise. When the high side of cam 46 is dead center on the roller bearing 50, the patient's head is in the most retracted position of the therapeutic cycle. At that instant, a timer (not shown in the drawings for clarity) stops the mechanical motion for a holding phase of predetermined duration (approximately five seconds). The patient's head is maintained in the retracted position during this holding phase by the rearward tension exerted on the patient's head by the mechanism and by the developing muscle strength of the patient. The timer allows the motor 26 to restart, and as the high side of the cam 46 rotates off dead center, tension on the forehead band 52 and the chin band 56 is reduced, indicating to the patient that the tensed muscles should be relaxed. Approximately ten seconds elapse from the end of one holding phase to the beginning of the next, that is, from the moment the high side of the cam 46 begins to move off dead center of the roller bearing 50, and makes one complete revolution until the high side of said cam is once again dead center on said roller bearing, and consequently one therapeutic cycle lasts approximately fifteen seconds. This cycle is repeated for the duration prescribed for the therapy session.

Still referring to FIG. 1, the treatment cams 46 are of various sizes, for instance a ¼ inch cam will move the head rearward approximately ¼ inch. Said cam is sued until the affected muscles are sufficiently strengthened that the head can be maintained in the ¼ inch retracted position under the patient's own power and without assistance from the therapeutic device. At that time, the cam size can be increased and the therapy process repeated until the desired position of the head and neck (i.e., proper cervical spine alignment) is achieved and can be maintained without help, or at least until the muscle groups necessary for achieving and maintaining correct head and neck posture are strong enough to enable continuance of therapeutic exercise unassisted.

A preferred embodiment of the invention and its utilization have now been described in detail. Since changes and modifications to the above preferred embodiment may be made without departing from the spirit of the invention, the scope of the invention is not to be limited to the foregoing details, except as set forth in the appended claims.

What is claimed is:

1. A head, neck, and shoulder therapeutic exercise device comprising:

a frame;

an electric motor assembly supported on said frame, said assembly comprising a motor having a shaft and means for reducing the rotational speed of said shaft;

back head rest means for restricting the backward movement of a patient's head during treatment;

means for implementing or assisting the backward and forward movement of a patient's head during treatment, said means for implementing or assisting including a cam, said cam mounted on said shaft;

a roller bearing plate housing a roller bearing, said roller bearing positioned to be in contact with the outer edge of said cam;

means for restraining the forehead and chin of a patient to said roller bearing plate;

a roller block assembly for selectively positioning said back head rest means to be in contact with the back of a patient's head during treatment, and for facilitating the backward and forward movement during treatment of said back head rest means and said roller bearing plate, said back head rest means and said roller bearing plate being affixed to aid roller block assembly;

a timer for selectively and cyclically stopping and restarting said motor during treatment;

wherein upon motorized rotation of the shaft, the high side of the cam contacts the roller bearing causing the roller bearing plate to move away from the patient's head thereby tensioning the means for restraining the head, whereupon the timer briefly stops the motor leaving the roller bearing plate in retracted position until the motor restarts causing the high side of the cam to rotate out of contact with the roller bearing thereby allowing the roller bearing plate and means for restraining the head to return to original position.

2. The head, neck, and shoulder therapeutic exercise device of claim 1 further comprising height adjustment means and adjustable back support means for accommodating said frame to fit various sizes of patients.

3. The head, neck, and shoulder therapeutic exercise device of claim 1 wherein said cam is interchangeable with other cams of various sizes for precisely controlling the distance of backward and forward head movement during treatment.

* * * * *

UNITED STATES PATENT AND TRADEMARK OFFICE

CERTIFICATE OF CORRECTION

PATENT NO. : 5,116,359

DATED : May 26, 1992

INVENTOR(S) : Joseph L. Moore

It is certified that error appears in the above-identified patent and that said Letters Patent is hereby corrected as shown below:

Column 6, line 42, should read:
"and said roller bearing plate being affixed to said"

Signed and Sealed this

Second Day of November, 1993

*Attest:*

*Attesting Officer*

BRUCE LEHMAN

*Commissioner of Patents and Trademarks*